US005494408A

United States Patent [19]

Seeley et al.

[11] Patent Number: 5,494,408

[45] Date of Patent: Feb. 27, 1996

[54] BUCKET TO WHEEL DOVETAIL DESIGN FOR TURBINE ROTORS

[75] Inventors: Robert E. Seeley, Broadalbin; Raymond J. Jones, Duanesburg; Carl L. De Cesare; James H. Vogan, both of Schenectady; Joseph H. Stocks, III, Scotia, all of N.Y.; Carlos E. Silva, Greenville, S.C.

[73] Assignee: General Electric Co., Schenectady, N.Y.

[21] Appl. No.: 321,958

[22] Filed: Oct. 12, 1994

[51] Int. Cl.[6] ..... F01D 5/30

[52] U.S. Cl. ..... 416/222; 416/217; 416/248

[58] Field of Search ..... 416/222, 217, 416/219 R, 248

[56] References Cited

U.S. PATENT DOCUMENTS

| | | | |
|---|---|---|---|
| 4,191,509 | 3/1980 | Leonardi | 416/219 R X |
| 4,692,976 | 9/1987 | Andrews | 416/219 R |
| 4,824,328 | 4/1989 | Pisz et al. | 416/219 R |
| 5,147,180 | 9/1992 | Johnson | 416/219 R |
| 5,160,242 | 11/1992 | Brown | 416/219 R |
| 5,176,500 | 1/1993 | Heinig | 416/219 R |

*Primary Examiner*—Edward K. Look
*Assistant Examiner*—Michael S. Lee
*Attorney, Agent, or Firm*—Nixon & Vanderhye

[57] ABSTRACT

In a steam turbine rotor wheel and bucket dovetail joint construction wherein the wheel dovetail includes three radially aligned hooks each interconnected by a neck having an upper and lower fillet, an improvement includes redesigned fillet radii which, in a first embodiment, include the upper fillet having a radius greater than the lower fillet radius. In certain embodiments, the upper fillet may have a radius twice that of the lower fillet. In other embodiments, the radii in both the upper and lower fillets have been enlarged.

10 Claims, 7 Drawing Sheets

BUCKET TO WHEEL DOVETAIL DESIGN FOR TURBINE ROTORS

TECHNICAL FIELD

This invention relates to steam turbines in general, and to the dovetail attachment between steam turbine rotors and steam turbine buckets in particular.

BACKGROUND

Dovetail attachment techniques between turbine buckets and turbine rotor wheels are well known in the art. It has been found, however, that conventional tangential entry dovetails on the latter stages of low pressure rotors operate in an environment that is conducive to stress corrosion cracking (SCC). SCC is accelerated by the stress levels that are present in the hook fillet region of typical dovetail configurations. Normally, these stresses are acceptable, but in contaminated steam, cracks can initiate and, if left undetected, grow to a depth that may cause failure of the wheel hooks. In extreme cases, all of the hooks may fail and buckets may fly loose from the rotor.

It has been found generally that the cracking problem described above occurs primarily in wheel hooks rather than in the complementary bucket hooks. This is apparently because the steels, such as NiCrMoV, used for low pressure rotors are much less resistant to SCC than are the 12 Cr steels used for buckets. The low pressure steels, however, give the optimum combination of properties available for overall low pressure rotor design considerations. Therefore, an effective means of reducing the probability of initiating SCC in the typical low pressure steam environment is not to change materials but, rather, to reduce the stresses in the wheel dovetail to acceptable levels. If the maximum stress in components operating in a corrosive environment is reduced below the yield strength of the material, the resistance to SCC is greatly improved.

DISCLOSURE OF THE INVENTION

It is thus the principal object of this invention to provide a bucket to rotor wheel dovetail attachment configuration for low pressure rotors that have peak stresses that are low enough to avoid SCC of the wheel hooks. At the same time, it is also an object to maintain an overall configuration that is compatible with existing bucket dovetails to thereby allow interchangeability of buckets and bucket dovetail cutters.

In accordance with an exemplary embodiment of the invention, and in order to accomplish the desired stress reduction, the radius of upper and lower fillets between each radially adjacent pair of hooks has been increased and at the same time, in order to avoid interference with the existing bucket dovetail, the thickness of each dovetail neck portion has been decreased. For purposes of discussion in this patent application, reference to a dovetail neck, or neck, refers to the dovetail portion extending axially (in the direction of the rotor) between laterally adjacent hooks, and radially between radially adjacent pairs of hooks.

Similar design changes have been made to various specific wheel dovetail configurations in accordance with other exemplary embodiments of the invention.

Accordingly, in its broader aspects, the present invention relates to a steam turbine rotor wheel and bucket dovetail joint construction wherein the wheel dovetail includes three radially aligned hooks each interconnected by a neck having an upper fillet and a lower fillet, the improvement comprising the upper fillet having a radius greater than that of the lower fillet.

In another aspect, the invention relates to a steam turbine rotor wheel and bucket dovetail joint construction wherein the wheel dovetail includes three radially aligned hooks interconnected by a respective pair of substantially identical fillets, the improvement comprising an upper half portion of each fillet having a radius substantially twice that of a lower half portion of the fillet.

In still another aspect, the invention relates to a steam turbine rotor wheel and bucket dovetail joint construction wherein the wheel dovetail includes three radially aligned hooks each interconnected by a neck having an upper fillet and a lower fillet, the improvement wherein the upper and lower fillets have a radius of about 0.125 in.

In each of the described embodiments, reduction in peak stress in the fillets between the neck and hook of the wheel dovetails has been effected through specific design changes detailed herein.

Additional objects and advantages of the invention will become apparent from the detailed description which follows.

BEST MODE FOR CARRYING OUT THE INVENTION

Figure 1:
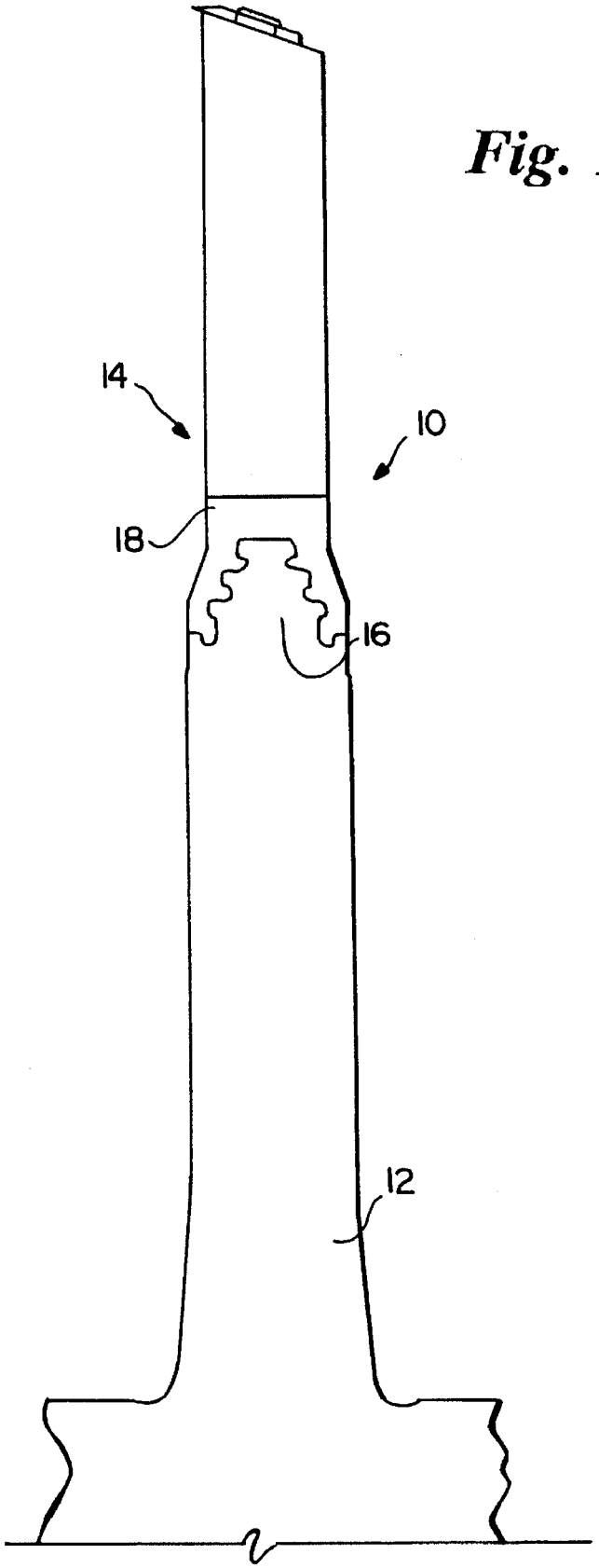
Fig. 1 (PRIOR ART)
FIG. 1 is a partial side elevation of a rotor body, rotor wheel and bucket incorporating a wheel/bucket dovetail in a conventional prior art arrangement.

FIG. 1 illustrates generally a conventional dovetail joint 10 between a turbine rotor wheel 12 and a turbine bucket 14.

The wheel dovetail 16 is formed integrally with the wheel 12 and typically permits mounting of bucket 14 via bucket dovetail 18 in a "tangential entry" configuration which, per se, is well known.

Figure 2:
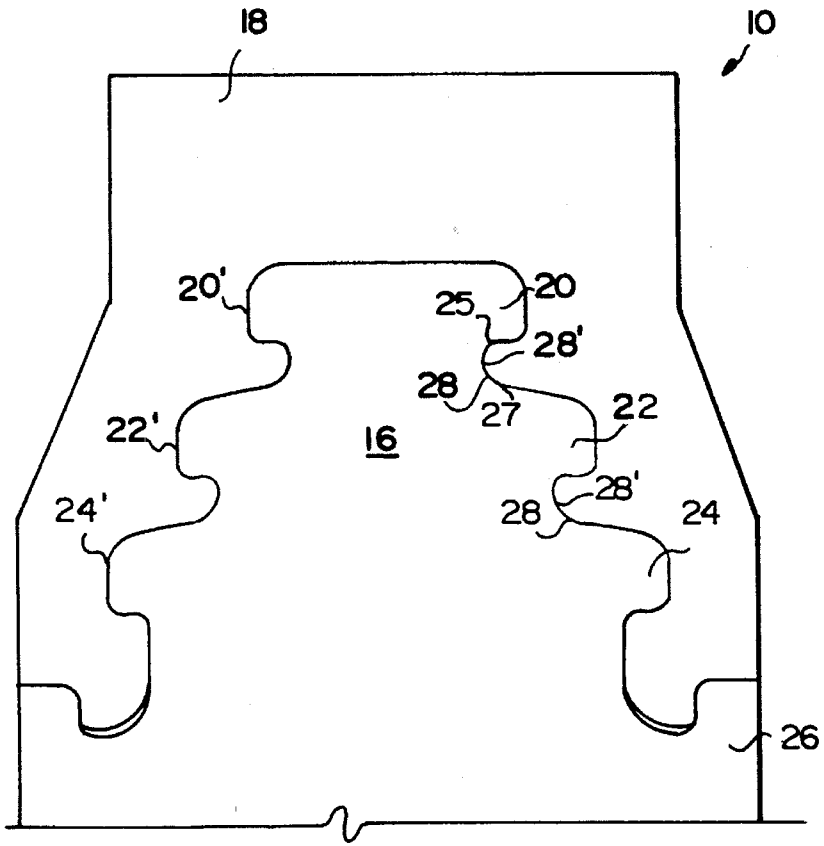
Fig. 2 (PRIOR ART)
FIG. 2 is an enlarged detail illustrating the conventional bucket and wheel dovetail arrangement as shown in FIG. 1.

As already noted above, it is accepted practice to describe dovetails in terms of one half of the design, due to symmetry of the design about a radial plane. Referring to FIG. 2, the dovetail 16 may be described as having three hooks 20, 22 and 24, along with a tang portion 26 at the base of the dovetail. The respective radially adjacent hooks are each connected via neck 28 (mated with bucket dovetail projections 28') having upper and lower fillets 25 and 27 respectively, and it is in this area that the present invention provides improved performance. The relatively snug fit between the wheel and bucket dovetails is apparent, and, for the sake of convenience, the corresponding bucket hook recesses are referenced by numerals 20', 22' and 24'.

FIG. 2 illustrates in more detail the conventional mating wheel and bucket dovetails 16, 18, respectively, and the relatively close fit therebetween.

Figure 3:
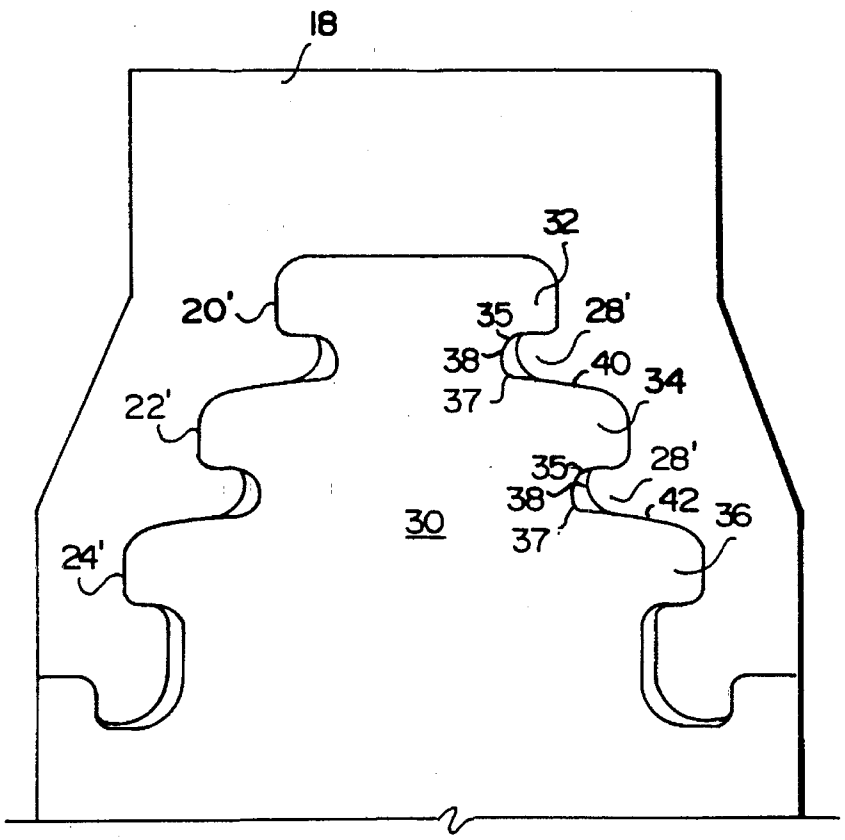
FIG. 3 is a side elevation of a bucket and wheel dovetail design in accordance with this invention.

FIG. 3 illustrates a new turbine wheel dovetail configuration 30 in accordance with this invention, in assembled relationship with the bucket dovetail 18 of FIG. 2. From this view, it can be appreciated that the new wheel dovetail 30 of this invention is indeed compatible with the prior bucket dovetail 18.

Figure 4:
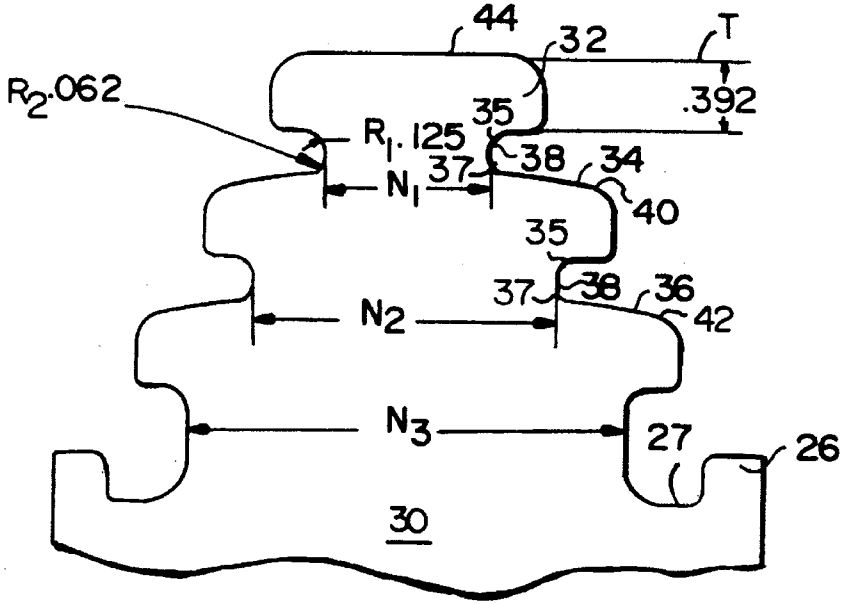
FIG. 4 is a side view of a wheel dovetail in accordance with an exemplary embodiment of the invention.

The wheel dovetail 30 includes upper, intermediate and lower hooks 32, 34 and 36, respectively, with the radially adjacent hooks each being interconnected by a neck 38 having an upper fillet radii 35 and a lower fillet radii 37. The hooks 34 and 36 are also characterized by slanted or inclined top surfaces 40 and 42, respectively, while uppermost hook 32 has a substantially flat top surface 44. With reference now to FIG. 4 (illustrating the wheel dovetail 30 alone), each hook 32, 34 and 36 has an effective thickness T (measured in a radial direction) of about 0.392 in., and the dovetail has an overall radial height of approximately 2.521 inches as measured from the base 27 of tang portion 26. The neck 38 between each radially adjacent pair of hooks has an upper fillet 35 having an enlarged radius of approximatly $0.125^{+}_{0.000-0.005}$ in. as compared to the conventional wheel dovetail. The lower fillet 37 has a conventional radius of $0.062^{+}_{0.000-0.005}$ in., so that the new upper fillet radius is substantially twice that of the lower fillet radius. In order to accomplish this, the width, indicated by dimensions $N_1$, $N_2$ and $N_3$ (axial distance between laterally adjacent fillets located between radially outer, intermediate and inner hooks, respectively) in FIG. 4, of each of the neck regions of the wheel dovetail is also reduced by 0.144 in. as compared to the conventional wheel dovetail. The new dimensions are as follows:

$N_1$ 0.0864 in.

$N_2$ 1.1614 in.

$N_3$ 2.358 in.

Figure 5:
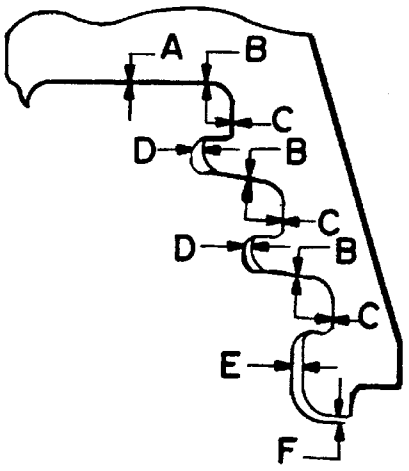
FIG. 5 is a partial side view illustrating tolerances between the bucket and wheel dovetails respectively in accordance with the invention.

The above changes result in clearance dimensions between wheel and bucket dovetails as noted below in Table I and keyed to FIG. 5.

TABLE I

| ASSY. CLEARANCES (IN INCHES) | A | B | C | D | E | F |
|---|---|---|---|---|---|---|
| MAXIMUM | .024 | .027 | .017 | .079 | .074 | .041 |

TABLE I-continued

| ASSY. CLEARANCES (IN INCHES) | A | B | C | D | E | F |
|---|---|---|---|---|---|---|
| MINIMUM | .002 | .003 | .003 | .065 | .068 | .021 |

The design modifications described above reduce SCC susceptibility in turbine wheel dovetails while maintaining a configuration compatible with the existing bucket dovetail. A finite element stress analysis of this dovetail gave a peak stress of 87000 p.s.i. which is slightly below the typical yield strength of 90,000 p.s.i. for the NiCrMoV rotor material. This represents a 26% reduction in peak stress from the original design.

Figure 7:
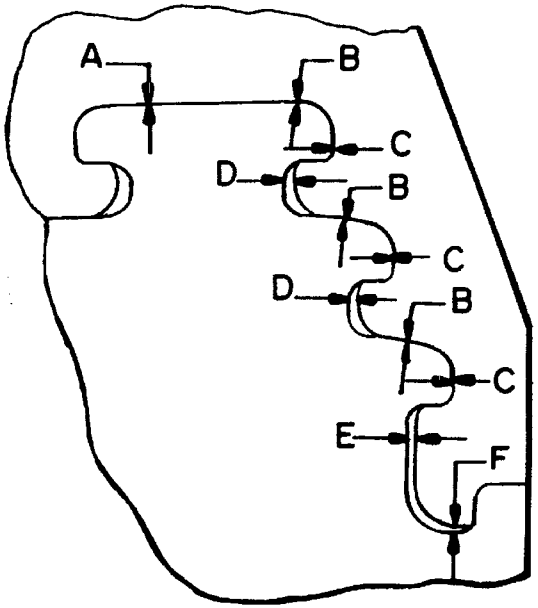
FIG. 7 is a partial side section illustrating the wheel dovetail in FIG. 6 in association with an associated bucket dovetail.
Figure 6:
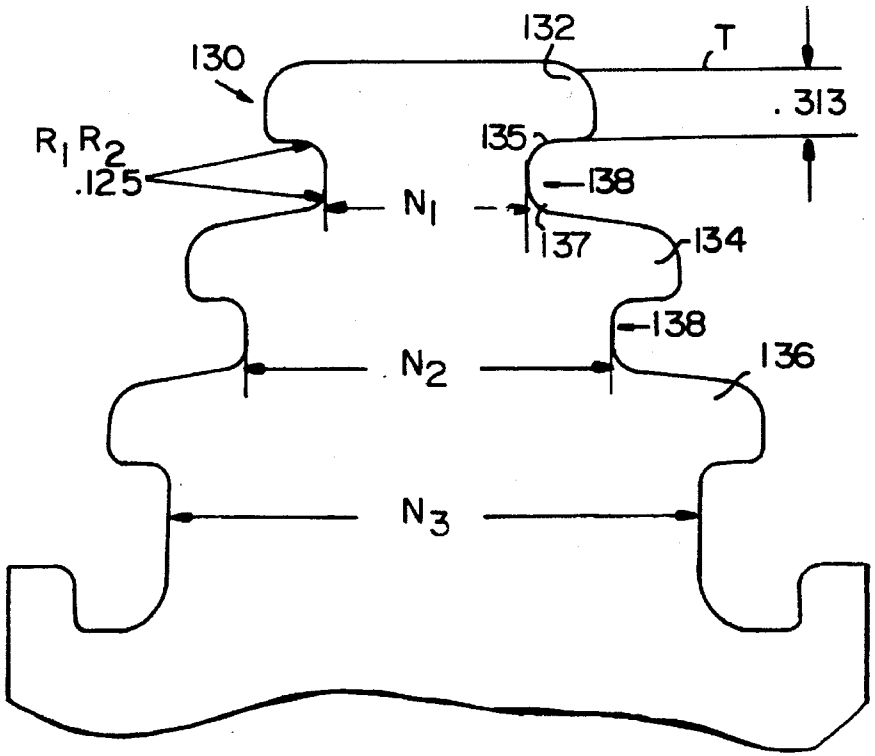
FIG. 6 is a partial section of a wheel dovetail in accordance with a second exemplary embodiment of the invention.

In a second exemplary embodiment illustrated in FIGS. 6 and 7, each hook 132, 134 and 136 of the wheel dovetail 130 has an effective thickness T of about 0.313 in., and the dovetail again has an overall radial height of approximately 2.521 in., and the upper and lower fillet radii 135 and 137, respectively, of each neck 138 have been modified such that both upper and lower fillets have an enlarged 0.125 inch radius (with tolerances similar to the first described embodiment). Neck width dimensions $N_1$, $N_2$ and $N_3$ each have been reduced by 0.126 in as compared to the conventional wheel dovetail. New neck width dimensions are as follows:

$N_1$ 0.864 in.

$N_2$ 1.614 in.

$N_3$ 2.364 in.

Clearance dimensions, keyed to FIG. 7, as between the new wheel dovetail and the existing bucket dovetail, are shown below in Table II.

TABLE II

| ASSY. CLEARANCES (IN INCHES) | A | B | C | D | E | F |
|---|---|---|---|---|---|---|
| MAXIMUM | .024 | .025 | .017 | .079 | .071 | .041 |
| MINIMUM | .002 | .003 | .003 | .065 | .065 | .021 |

A finite element stress analysis for this embodiment gave a peak stress of 91,000 p.s.i. (only slightly above the typical 90,0000 p.s.i. yield strength), a 21% reduction in peak stress from the original design.

Figure 9:
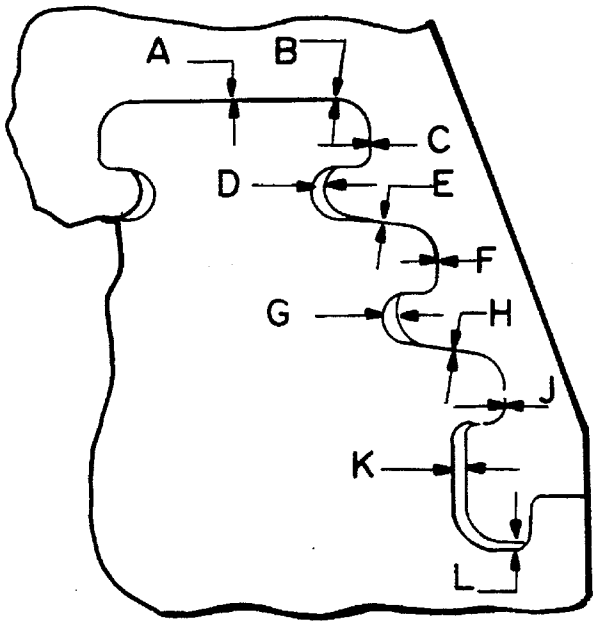
FIG. 9 is a partial cross section of the wheel dovetail illustrated in FIG. 8, in association with an existing bucket dovetail.
Figure 8:
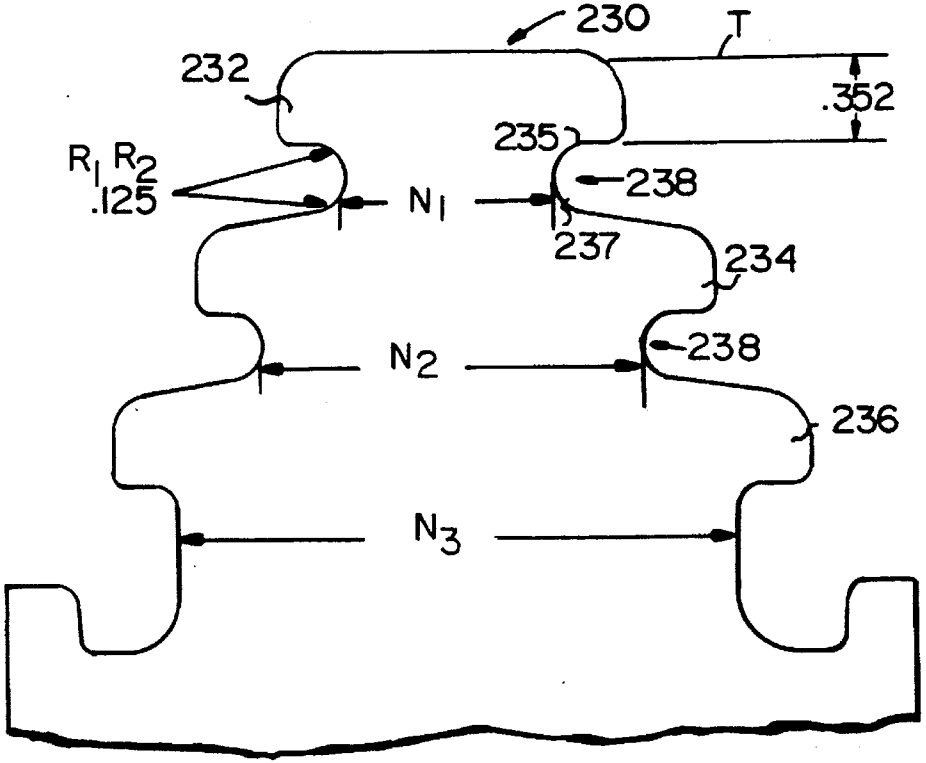
FIG. 8 is a partial side view of a wheel dovetail in accordance with a third exemplary embodiment of the invention.

In a third exemplary embodiment, and with reference to FIGS. 8 and 9, each hook 232, 234 and 236 of the wheel dovetail 230 has an effective thickness T of about 0.352 in., and the dovetail again has an overall radial height of approximately 2.521 in. The upper and lower fillet radii 235 and 237, respectively, of each neck 238 have been modified such that both upper and lower fillets have a 0.125 radius (with tolerances similar to the first described embodiment). The neck width dimensions $N_1$, $N_2$ and $N_3$ have been reduced by 0.144 in as compared to the conventional wheel dovetail. New values for $N_1$, $N_2$ and $N_3$ are as follows:

$N_1$ 0.864 in.

$N_2$ 0.614 in.

$N_3$ 2.358 in.

Clearance dimensions, keyed to FIGS. 8 and 9, as between the new wheel dovetail and the bucket dovetail, are shown below in Table III.

TABLE III

| ASSY. CLEARANCES (IN INCHES) | A | B | C | D | E | F | G | H | J | K | L |
|---|---|---|---|---|---|---|---|---|---|---|---|
| MAXIMUM | .024 | .028 | .017 | .079 | .028 | .017 | .079 | .028 | .017 | .074 | .041 |
| MINIMUM | .002 | .004 | .003 | .065 | .004 | .003 | .065 | .004 | .003 | .068 | .021 |

Figure 11:
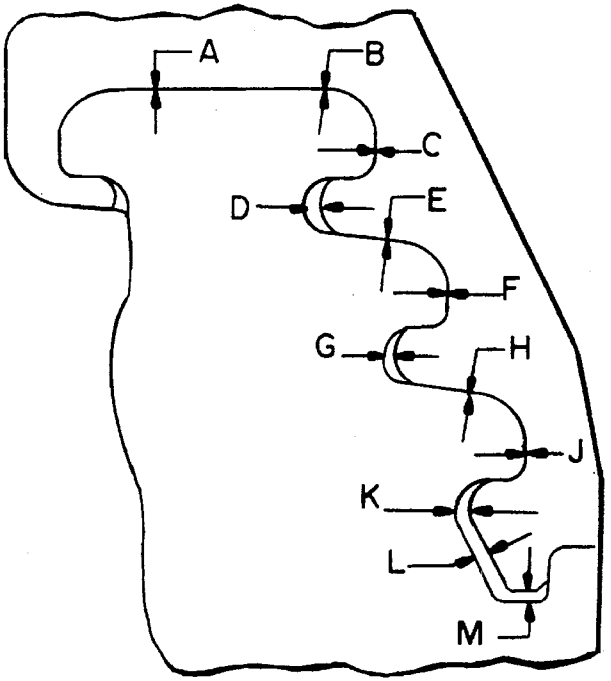
FIG. 11 is a partial side section of the dovetail illustrated in FIG. 10, in association with an existing bucket dovetail.
Figure 10:
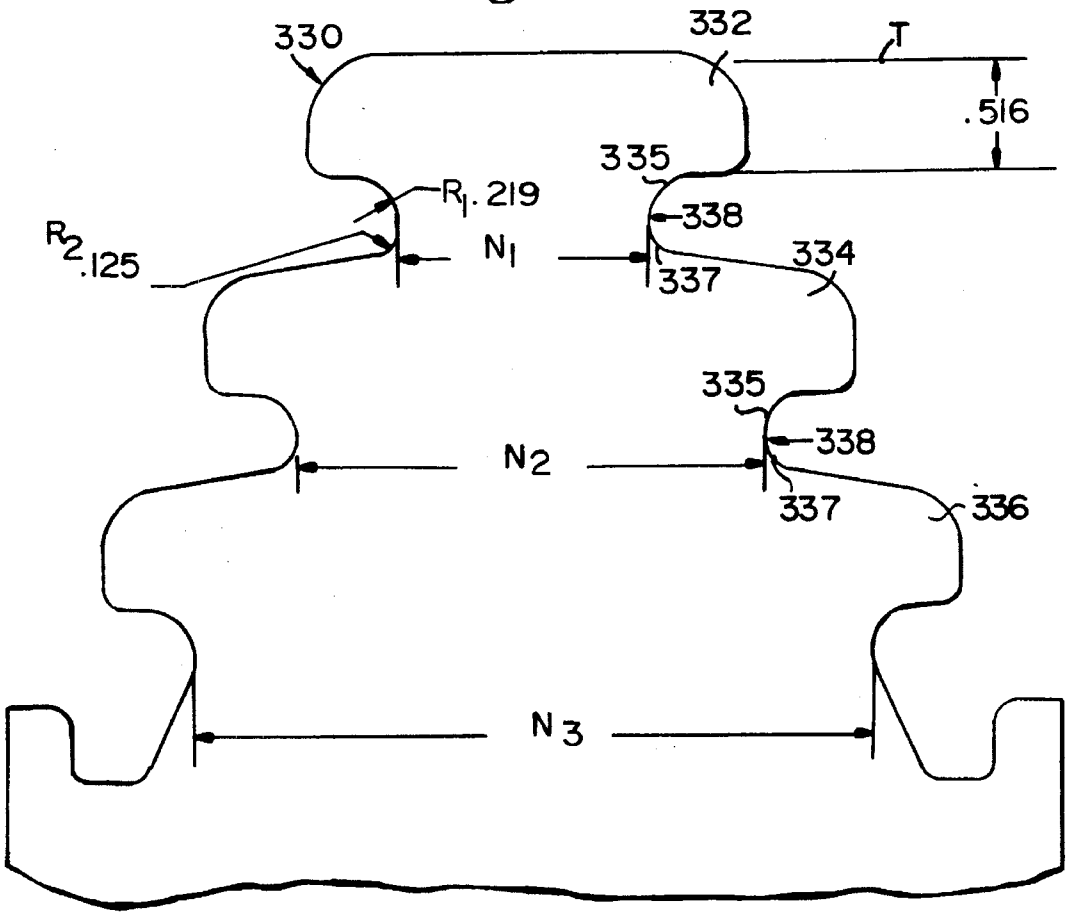
FIG. 10 is a partial side elevation of a wheel dovetail in accordance with a fourth exemplary embodiment of the invention.

In a fourth exemplary embodiment, and with reference to FIGS. 10 and 11, each hook 332, 334 and 336 of the wheel dovetail 330 has an effective thickness T of about 0.516 in. The dovetail has an overall radial height of approximately 3.394 in. The upper and lower fillet radii 335 and 337, respectively, of each neck 338 have been increased in the upper fillet from 0.125 to 0.219 inch, while the radius in the lower fillet has been retained at 0.125 in. (with tolerances similar to the first described embodiment). The neck width dimensions $N_1$, $N_2$ and $N_3$ have been reduced somewhat compared to the conventional wheel dovetail. New neck width dimensions are as follows:

$N_1$ 1.154 in.

$N_2$ 2.160 in.

$N_3$ 3.166 in.

Clearance dimensions, keyed to FIGS. 10 and 11, as between the new wheel dovetail and the bucket dovetail, are shown below in Table IV.

TABLE IV

| ASSY. CLEARANCES (IN INCHES) | A | B | C | D | E | F | G | H | J | K | L | M |
|---|---|---|---|---|---|---|---|---|---|---|---|---|
| MAXIMUM | .024 | .029 | .019 | .111 | .029 | .019 | .111 | .029 | .019 | .106 | .093 | .073 |
| MINIMUM | .002 | .004 | .005 | .097 | .004 | .005 | .097 | .004 | .005 | .100 | .088 | .053 |

The finite element stress analysis of the dovetail for the fourth embodiment gave a peak stress of 75,000 p.s.i., a 20% reduction from the original design.

Figure 13:
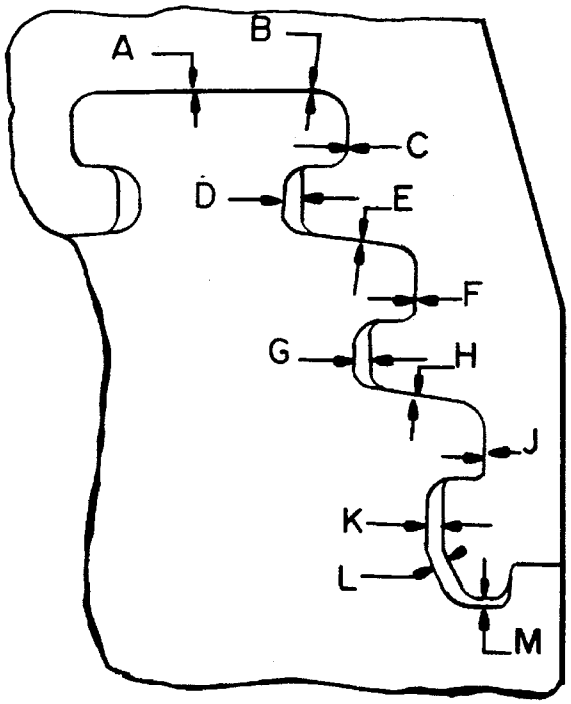
FIG. 13 is a partial side section illustrating the wheel dovetail of FIG. 12 in association with an associated bucket dovetail.
Figure 12:
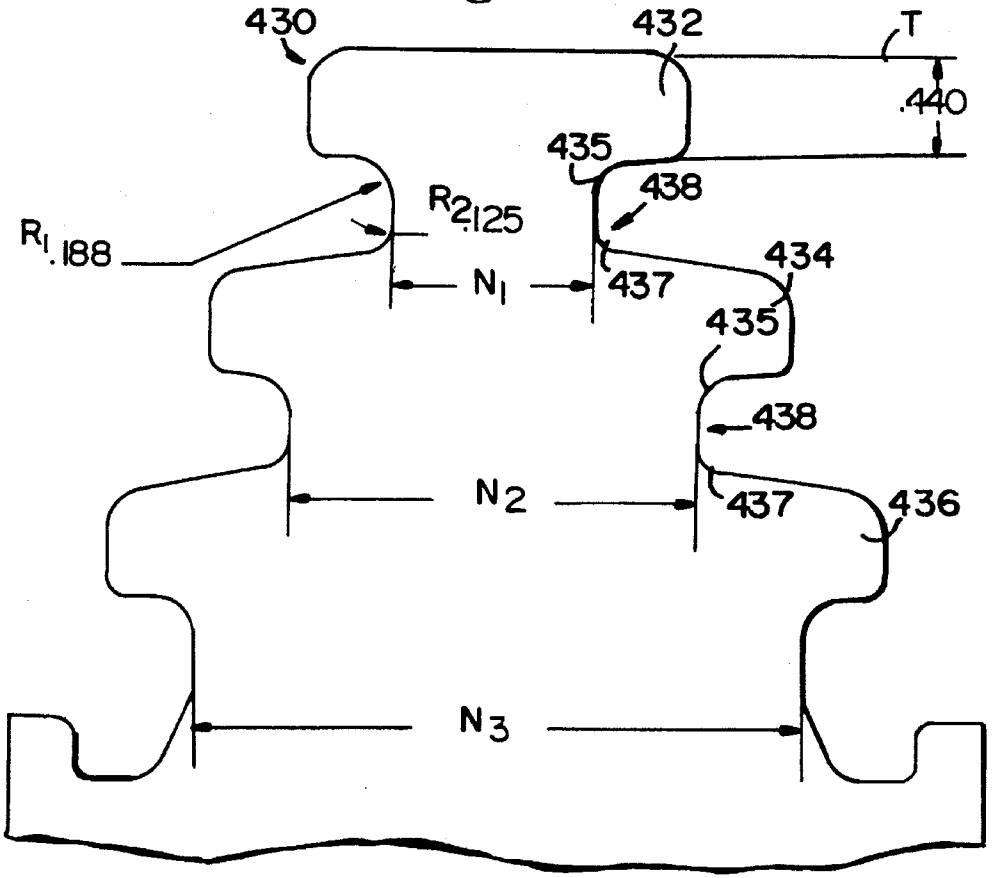
FIG. 12 is a partial side elevation of a wheel dovetail in accordance with a fifth exemplary embodiment of the invention.

In a fifth exemplary embodiment, and with reference to FIGS. 12 and 13, each hook 432, 434 and 436 of the wheel dovetail 430 has an effective thickness T of about 0.440 in. The overall radial height of the dovetail is approximately 3.225 in. The upper and lower fillet radii 435 and 437, respectively, of each neck 438 have been increased in the upper fillet from 0.090 in to 0.188 in., while the radius in the lower fillet has been maintained at 0.125 in. (with tolerances similar to the first described embodiment). To avoid interference, the neck width dimension $N_1$, $N_2$ and $N_3$ have been reduced by 0.196 in as compared to the conventional wheel dovetail. New values for the neck width dimensions are as follows:

$N_1$ 0.884 in.

$N_2$ 1.794 in.

$N_3$ 2.704 in.

Clearance dimensions, keyed to FIGS. 12 and 13, as between the new wheel dovetail and the bucket dovetail, are shown below in Table IV.

TABLE V

| ASSY. POSS. CLEARANCE (IN INCHES) | A | B | C | D | E | F | G | H | J | K | L | M |
|---|---|---|---|---|---|---|---|---|---|---|---|---|
| MAXIMUM | .024 | .027 | .017 | .115 | .027 | .017 | .115 | .027 | .017 | .110 | .107 | .040 |
| MINIMUM | .002 | .002 | .003 | .101 | .002 | .003 | .101 | .002 | .003 | .104 | .098 | .020 |

The finite element stress analysis for this fifth embodiment gave a peak stress of 92,000 p.s.i., only slight above the typical 90,000 p.s.i. yield strength of the NiCrMoV material. This represents a 22% reduction of peak stress from the original design.

Specific dimensions provided herein are exemplary only and are not intended to limit the scope of the claims. In other words, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a steam turbine rotor wheel and bucket dovetail joint construction wherein the rotor wheel is formed with a circumferential male dovetail component and wherein a female bucket dovetail is received on the male dovetail component of the wheel in a direction tangent to the wheel, and wherein the wheel dovetail includes three radially aligned hooks each interconnected by a neck having an upper fillet and a lower fillet, the improvement comprising the upper fillet having a radius greater than that of the lower fillet.

2. The improvement of claim 1 wherein said upper fillet has a radius of approximately 0.125 in. and wherein the lower fillet has a radius of approximately 0.062 in.

3. The improvement of claim 1 wherein a lowermost of the three hooks has a third fillet therebelow having a radius of approximately 0.125 in.

4. The improvement of claim 1 wherein said upper fillet has a radius of approximately 0.219 in. and wherein the lower fillet has a radius of approximately 0.125 in.

5. The improvement of claim 1 wherein said upper fillet has a radius of approximately 0.188 in. and wherein the lower fillet has a radius of approximately 0.125 in.

6. In a steam turbine rotor wheel and bucket dovetail joint construction wherein the rotor wheel is formed with a circumferential male dovetail component and wherein a female bucket dovetail is received on the male dovetail component of the wheel in a direction tangent to the wheel, and wherein the wheel dovetail includes three radially aligned hooks each interconnected by a neck having an upper fillet and a lower fillet, the improvement comprising each upper fillet having a radius substantially twice that of the lower fillet.

7. The improvement of claim 1 wherein said radius of said upper fillet is approximately 0.125 in.

8. The improvement of claim 7 wherein a neck dimension between axially adjacent fillets located between radially outer and radially intermediate hooks is about 0.864 in.

9. The improvement of claim 7 wherein a neck dimension between axially adjacent fillets located between radially intermediate and radially inner hooks is no greater than about 1.614 in.

10. In a steam turbine rotor wheel and bucket dovetail joint construction wherein the rotor wheel is formed with a circumferential male dovetail component and wherein a female bucket dovetail is received on the male dovetail component of the wheel in a direction tangent to the wheel, .and wherein the wheel dovetail includes three radially aligned hooks each interconnected by a neck having an upper fillet and a lower fillet, the improvement wherein the upper and lower fillets have radii of about 0.125 in.

* * * * *